US007458572B2

(12) United States Patent
Sato et al.

(10) Patent No.: US 7,458,572 B2
(45) Date of Patent: Dec. 2, 2008

(54) BANKNOTE FEEDING APPARATUS

(75) Inventors: Hiroyuki Sato, Hyogo (JP); Hiroshi Morita, Hyogo (JP)

(73) Assignee: Glory Ltd., Hyogo (JP)

( * ) Notice: Subject to any disclaimer, the term of this patent is extended or adjusted under 35 U.S.C. 154(b) by 190 days.

(21) Appl. No.: 11/488,973

(22) Filed: Jul. 18, 2006

(65) Prior Publication Data

US 2007/0018380 A1 Jan. 25, 2007

(30) Foreign Application Priority Data

Jul. 19, 2005 (JP) ..... 2005-208677

(51) Int. Cl.
*B65H 3/06* (2006.01)

(52) U.S. Cl. ..... 271/119; 271/120

(58) Field of Classification Search ..... 271/119, 271/120

See application file for complete search history.

(56) References Cited

U.S. PATENT DOCUMENTS

| | | | | |
|---|---|---|---|---|
| 3,157,868 | A | 11/1964 | Buslik | |
| 4,796,878 | A | 1/1989 | Nichelson et al. | |
| 5,687,963 | A * | 11/1997 | Mennie | 271/119 |
| 6,073,744 | A * | 6/2000 | Raterman et al. | 194/207 |
| 6,186,490 | B1 * | 2/2001 | Sugiura et al. | 271/10.09 |
| 6,237,739 | B1 * | 5/2001 | Mazur et al. | 194/207 |
| 6,378,683 | B2 * | 4/2002 | Mennie | 194/207 |
| 6,628,816 | B2 * | 9/2003 | Mennie et al. | 382/135 |
| 6,636,624 | B2 * | 10/2003 | Raterman et al. | 382/135 |
| 6,980,684 | B1 * | 12/2005 | Munro et al. | 382/135 |
| 7,232,024 | B2 * | 6/2007 | Mazur et al. | 194/207 |

FOREIGN PATENT DOCUMENTS

| | | |
|---|---|---|
| EP | 0 706 145 A | 4/1996 |
| EP | 1 241 637 A | 9/2002 |
| JP | 06-236462 | 8/1994 |
| WO | 84/02327 A | 6/1984 |

* cited by examiner

*Primary Examiner*—Kaitlin S Joerger
(74) *Attorney, Agent, or Firm*—Ladas & Parry LLP

(57) ABSTRACT

A banknote feeding apparatus for banknote counting machines with the function of verifying the authenticity of banknotes is provided, wherein the banknote feeding apparatus has a feeding mechanism which can ensure very stable banknote feeding even for very worn or damaged banknotes. The banknote feeding apparatus provides of a feeding mechanism for sequentially feeding out banknotes accumulated or stacked within a hopper and guiding each individual banknote to a stacker via a feed roller and then a magnetic head pad roller, the feeding mechanism having a banknote counting means, wherein an elastic belt is wound around both the feed roller and the magnetic head pad roller in a tensioned state and the elastic belt serves as a banknote feeding member and as a member for transmitting power between the respective rollers.

4 Claims, 3 Drawing Sheets

BANKNOTE FEEDING APPARATUS

FIELD OF THE INVENTION

The present invention relates to a banknote counting machine wherein banknotes stacked or accumulated within a hopper are separated one after another and individual banknotes are fed one by one to a banknote authenticity verification apparatus to verify the authenticity of each banknote and to count the number of banknotes. Specifically, this invention relates to a banknote feeding mechanism which ensures stable banknote feeding.

BACKGROUND OF THE INVENTION

Typically, banknote counting machines separate banknotes stacked or accumulated within a hopper one after the other, feed individual banknotes one by one to a counting apparatus and count the number of the banknotes therein. An example of such a banknote counting machine is described in Japanese Unexamined Patent Publication No. 6-236462 filed by the applicant.

Japanese Patent Publication No. 6-236462 details, as shown in FIG. 1, a banknote counting machine having feed-out rollers, such as a kicker roller (52) and a gate roller (53), for sequentially introducing banknotes (A) stacked or accumulated within a hopper (51); conveyance rollers, such as a feed roller (54) and acceleration rollers (55) and (56), for conveying the individual banknotes (A) which are fed by the feed-out rollers. Specifically, the banknotes stacked or accumulated within the hopper (51) are fed out from the lowermost banknote sequentially one after another by the kicker roller (52); each individual banknote is fed to the nip between the acceleration rollers (55) and (56) via the feed roller (54); the number of banknotes is counted as each banknote is passed through a non-contact optical sensor (S); and finally the banknotes are stacked or accumulated in a stacker (58) by means of a stacker fan (57). Japanese Patent Publication No. 6-236462 thus describes a machine specializing in counting the number of banknotes.

The aforementioned banknote counting machine is problem-free when there are no causes that produce feeding load in the banknote feeding path.

Recently, however, banknote counting machines also need to verify the authenticity of banknotes.

While various types of banknote authenticity verification techniques have been proposed, methods of detecting the magnetic output of magnetic ink are more commonly known. Focusing on the fact that authentic banknotes have regions printed with magnetic ink, whereas counterfeit banknotes duplicated through such methods as color copying do not, the aforementioned method uses a magnetic head to determine the presence of a magnetic field on the banknote and thereby verify its authenticity. For this purpose, a magnetic head is typically used for the detection of the magnetic ink. In such cases, however, the magnetic head has to be placed in contact with a moving banknote, which results in an increased feeding load.

For this reason, the inventors conducted various tests using the aforementioned conventional method by positioning the magnetic head in the banknote feeding path. As a result, it was found that relatively unworn or undamaged banknotes did not cause a problem, while very worn or damaged banknotes caused the magnetic head to affect the feeding load and induce paper jam.

SUMMARY OF THE INVENTION

Accordingly, in view of the aforementioned problems, the object of the invention is to provide a banknote feeding apparatus for banknote counting machines with a banknote authenticity verification function, wherein the banknote feeding apparatus comprises a feeding mechanism that ensures very stable feeding, even for very worn or damaged banknotes.

The above-described object of the invention is achieved through a banknote feeding apparatus that provides of a feeding mechanism for sequentially feeding out banknotes accumulated or stacked within a hopper and subsequently feeding each individual banknote to a stacker via a feed roller and then a pad roller with a magnetic head (hereinafter referred to as a magnetic head pad roller). The feeding mechanism has a banknote counting section, wherein an elastic belt is wound around both the feed roller and the magnetic head pad roller in a tensioned state. The elastic belt serves as a banknote feeding member and as a power transmission member between the respective aforementioned rollers.

Furthermore, the aforementioned object is satisfied by ensuring the elastic belt has the same outer perimeter radiuses around the feed roller and the magnetic head pad roller, which are substantially the same as the respective outer radiuses of the feed roller and the magnetic head pad roller.

Additionally, the aforementioned object is achieved by providing a feed roller surface made of a rubber material that produces a high coefficient of friction. The central portion the banknote is pressed against the elastic belt by the feed roller, with the side edge portions of the banknote being brought into contact with the feed roller surface. Therefore, the banknote is fed by friction through this plurality of contact on the banknote itself.

In addition, the aforementioned object is effectively achieved by placing the magnetic head pad roller so as to be spaced at a predetermined distance from the magnetic head.

As described above, based on the banknote feeding apparatus of the invention, banknotes fed out from the hopper are fed to a feed roller and then to the magnetic head pad roller, wherein the elastic belt is wound around both the feed roller and the magnetic head pad roller in a tensioned state and the center region of the banknote is pressed against the elastic belt by the feed roller. As a result, banknotes at the feed roller are fed by friction with the elastic belt in addition to friction with the roller surface (which consists of a material that produces a high coefficient of friction), increasing the reliability of banknote feeding. Specifically, the central portion of the banknote is pressed against the elastic belt (also referred to as a transport belt) by the feed roller and the side edge portions of the banknote are brought into contact with the rubber material of the feed roller. This results in banknotes being fed by friction at a total of three contact points. Furthermore, as the transport belt also serves as a power transmission member for transmitting power from the feed roller to the pad roller for the magnetic head (imparting a rotational force on the magnetic head pad roller), the feeding reliability of the transport belt is increased. As a result, the transport belt itself feeds banknotes, thereby increasing banknote feeding reliability and ensuring the stable feeding of even very worn or damaged banknotes.

DESCRIPTION OF THE PREFERRED EMBODIMENTS

In the following section, the present invention will be detailed with reference to the accompanying drawings.

Figure 1:
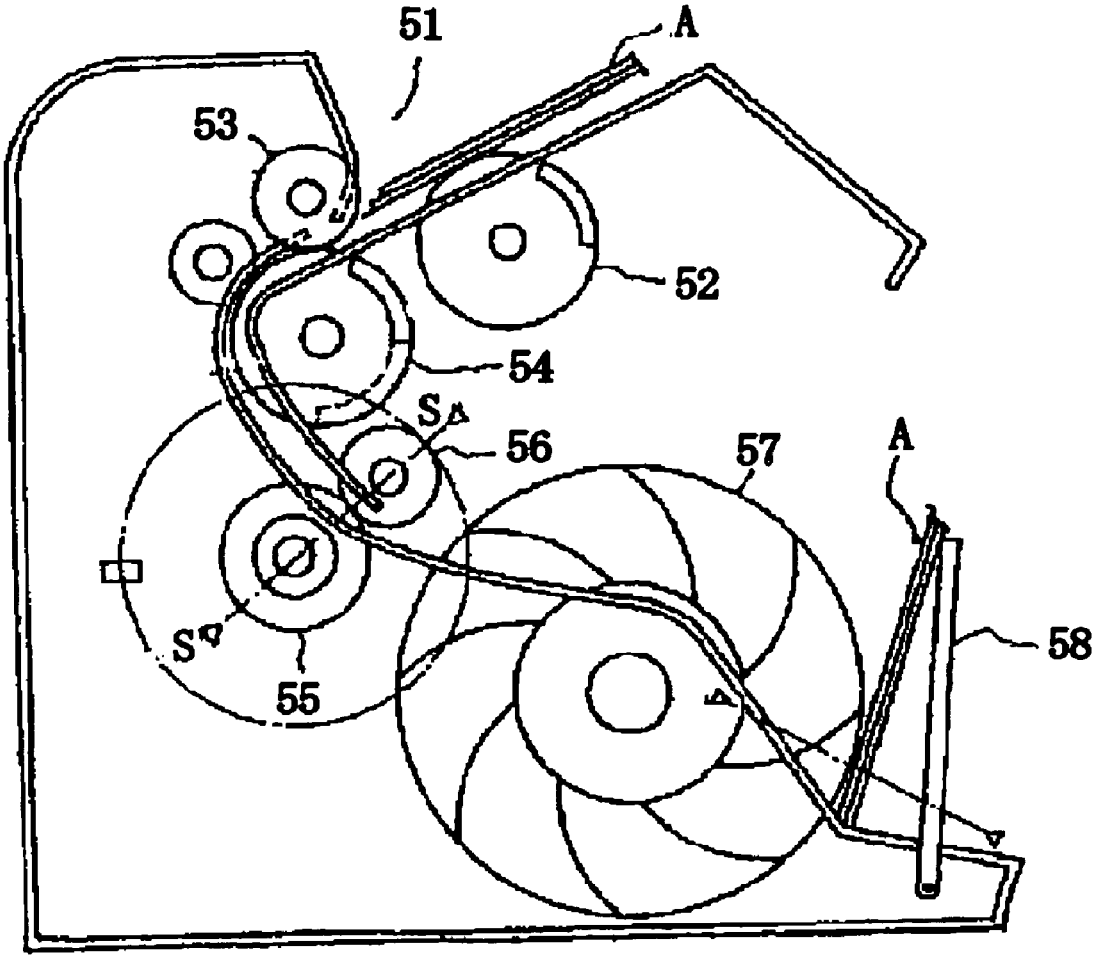
FIG. 1 shows the schematic structure of a conventional banknote feeding apparatus.
Figure 2:
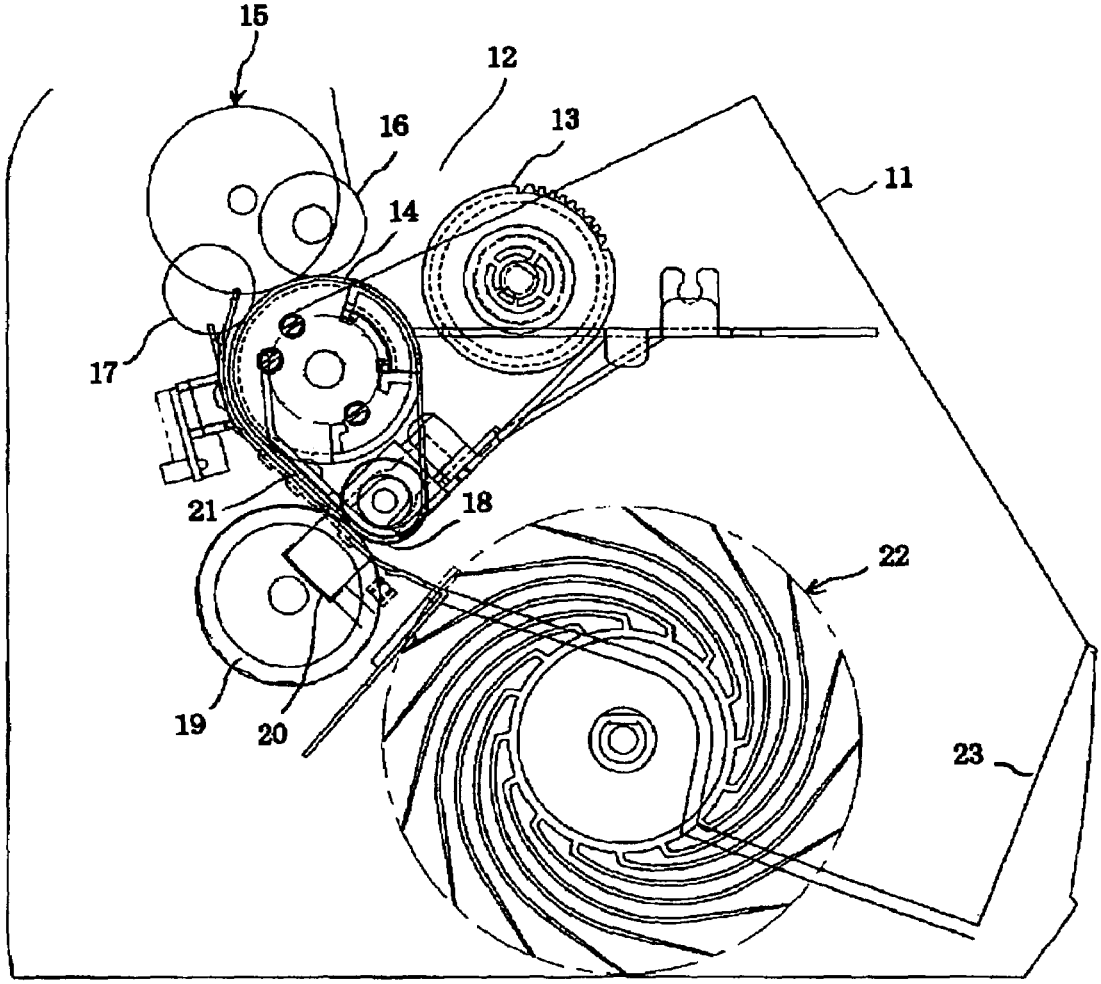
FIG. 2 shows the schematic structure of the feeding mechanism of the banknote feeding apparatus according to the invention.

FIG. 2 shows the schematic structure of the banknote feeding apparatus of the invention. Referring to FIG. 2, an outer casing (11) houses: means for separating and sequentially feeding out banknotes stacked within the hopper (12); and means for transporting the banknote from the feed-out apparatus towards the stacker through the banknote counting section and the banknote authenticity verification section.

The feed-out means consists of a kicker roller (13), a feed roller (14) and a gate member (15). The kicker roller (13) is a roller that is sequentially brought into contact with the surface of banknotes accumulated or stacked within the hopper (12) and kicks and feeds out each banknote through friction.

Specifically, the banknotes are picked up by a pickup roller (16) and accumulated or stacked within the hopper (12) and are kicked out one after another by the kicker roller (13). After passing through the nip (having a nip width less than the thickness of two banknotes) between the gate member roller (15) and the feed roller (14), the leading edge of the banknote is held between the feed roller (14) and a driven roller (17), which is brought into contact with the feed roller (14), and the banknote is transported downstream in the feeding direction. Specifically, the force of the driven roller (17) against the feed roller (14) feeds the banknote downstream.

It should be noted that the aforementioned pickup roller (16) is urged vertically downward by its own weight, so that power is not transmitted to the gate member (15) roller.

Furthermore, the transporting means consists of: the feed roller (14); the driven roller (17); a magnetic head pad roller (18) placed downstream in the feeding direction; and a driven roller (19) is brought into contact with the magnetic head pad roller (18).

Additionally, a magnetic head (20) for detecting the magnetic output of banknotes is placed between the magnetic head pad roller (18) and the driven roller (19). The magnetic head (20) is fixed to the outer casing (11) such that the magnetic head (20) is positioned at a predetermined distance (approximately 0.2 mm) from the magnetic head pad roller (18). Though not shown, the magnetic head pad roller (18) typically consists of a number of rubber rollers and is positioned to be opposed to the magnetic head at its centerline and to be brought into contact with the driven roller (19) at its laterally outside edges.

Figure 3:
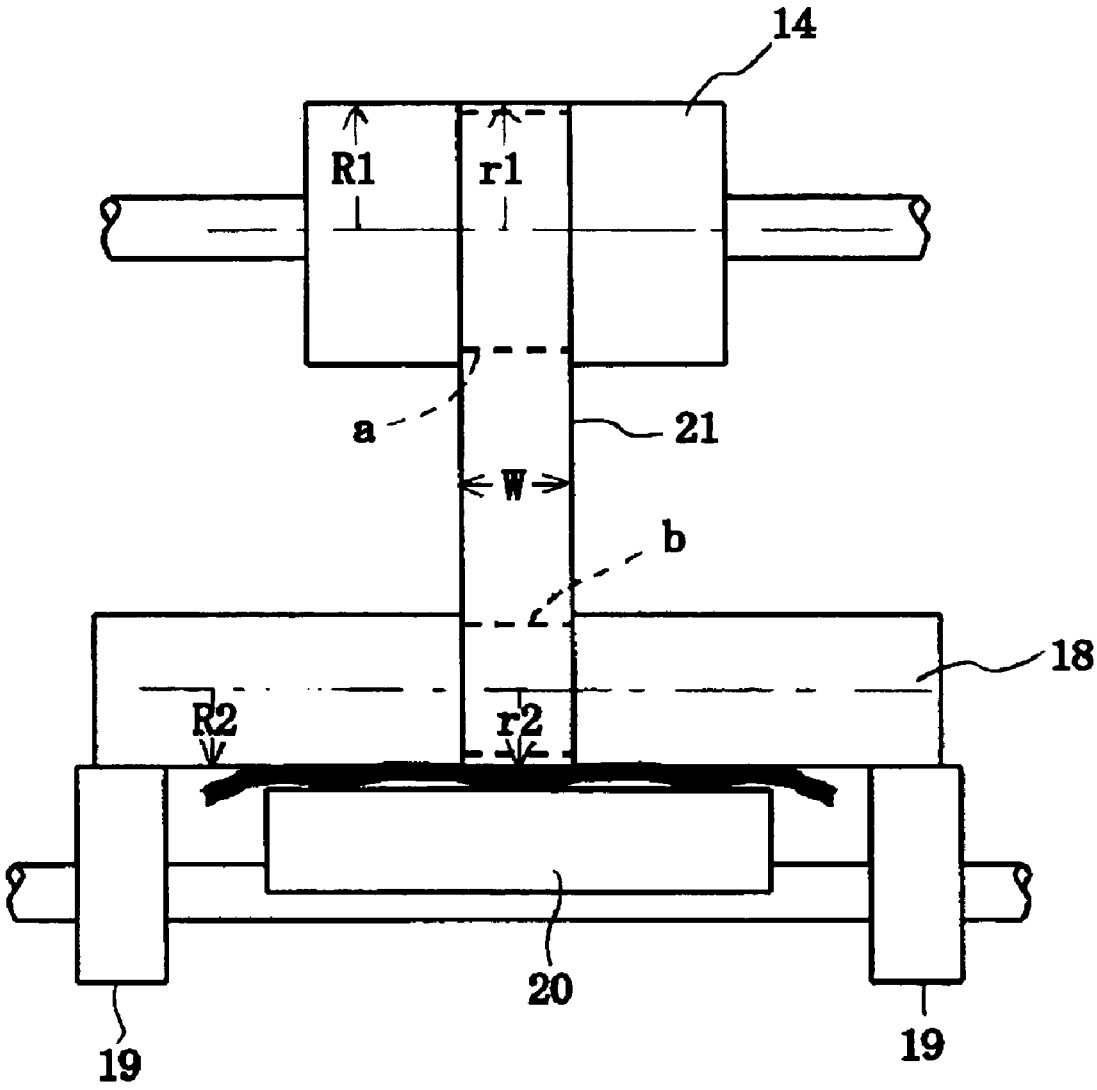
FIG. 3 illustrates the schematic structure of the transport belt stretched between the feed roller and the pad roller for the magnetic head within the feeding mechanism shown in FIG. 2.

A transport belt (21) consisting of an elastic material is wound around both the feed roller (14) and the pad roller (18) in a tensioned state. As shown in FIG. 3, these rollers (14) and (18) respectively have steps (a) and (b), each having a length corresponding to the width (w) of the transport belt (21), at a substantially axially-center portion thereof. The depth of the steps (a) and (b) is equivalent to the thickness of the transport belt (21). Therefore, the outer radius (R1) of the feed roller (14) has the same dimension as the outside perimeter radius (r1) of the transport belt (21), while the outer radius (R2) of the magnetic head pad roller (18) has the same dimension as the outside perimeter radius (r2) of the transport belt (21). As a result, banknotes fed by the transport belt (21) are always fed along laterally-flush surfaces, even when passing the feed roller (14) and the magnetic head pad roller (18), thereby preventing banknote feeding load.

In addition, the banknotes are counted by a counting sensor (not shown) at the magnetic head pad roller (18), while the magnetic head (20) detects the magnetic field generated by the magnetic ink printed on each banknote, verifying the authenticity of the banknote. After completion of banknote counting and authenticity verification, a stacker fan (22) is driven such that the banknotes are caught one by one between each adjacent pair of vanes and accumulated or stacked into to a stacker (23).

Furthermore, power is transmitted from a motor (not shown) to the kicker roller (13), the feed roller (14) and the rotor wheel of the stacker fan (22) through a timing belt, whereby a banknote is fed out from the hopper (12) to the stacker (23) through a passage which extends via the magnetic head pad roller (18) and so on. At this time, the transport belt (21), which is wound around the feed roller (14) and the pad roller (18) in a tensioned state, also plays a role in transmitting power to the magnetic head pad roller (18).

Thus, according to the embodiment described above, a banknote fed from the hopper (12) is fed to the feed roller (14) and the magnetic head pad roller (18) (wherein the elastic belt (21) is wound around the feed roller (14) and the magnetic head pad roller (18) in a tensioned state) and the laterally center portion of the banknote is pressed against the transport belt (21) by the feed roller (14). As a result, banknotes at the feed roller (14) are fed by friction with the elastic belt in addition to friction with the roller surface (consisting of a material, such as rubber, which produces a high coefficient of friction). This results in banknotes being fed by friction at a total of three contact points and increased reliability of banknote feeding.

In the foregoing embodiment, magnetic detection is used as a means for verifying the authenticity (or for detecting counterfeit banknotes) of banknotes. However, fluorescence detection may also be used as this means.

Specifically, the magnetic detecting means requires bringing the magnetic head into contact with a moving banknote and detecting magnetic output therefrom, while the fluorescence detecting means is "contact-less", consisting of an ultraviolet light radiation sensor and a sensor for detecting the light reflected from a moving banknote.

Two methods of the fluorescence detecting means are known: one for detecting the fluorescent reaction associated with the quality of the paper; and the other for detecting the presence of fluorescent ink.

In the former case, the fluorescent reaction is a phenomenon in which visible fluorescence is induced from the paper surface when it is illuminated with ultraviolet light. Using this method, banknotes that exhibit a fluorescent reaction due to paper quality are determined to be counterfeit. Paper used for banknotes does not exhibit this fluorescent reaction. This is universally true, even in the case of Chinese Yuan banknotes.

In the latter case, the authenticity of a banknote is verified depending of the presence of fluorescent ink when such fluorescent ink is used for printing banknotes. Specifically, if fluorescence caused by the presence of fluorescent ink is detected in a predetermined region of a banknote, then the banknote is determined to be an authentic banknote. For Chinese Yuan-banknotes, numerals representing its par value are printed in fluorescent ink at a predetermined region of the banknote and using the aforementioned feature is effective for banknote authenticity verification.

The invention claimed is:

1. A banknote feeding apparatus provides of a feeding mechanism for sequentially feeding out banknotes accumulated or stacked within a hopper and guiding each individual banknote to a stacker via a feed roller and then a magnetic head pad roller, the feeding mechanism having a banknote counting section, the banknote feeding apparatus comprising:

an elastic belt wound around both the feed roller and the magnetic head pad roller in a tensioned state, wherein the elastic belt serves as a banknote feeding member and as a power transmission member between the respective rollers, and wherein the feed roller is driven by a motor and the magnetic pad head roller is driven by the feed roller via the elastic belt.

2. The banknote feeding apparatus according to claim 1, wherein the magnetic pad head roller defines a groove having width and depth corresponding to width and thickness of the elastic belt.

3. The banknote feeding apparatus according to claim 1, characterized in that the feed roller has a surface made of a rubber material that produces a high coefficient of friction, the central portion of the banknote is pressed against the elastic belt by the feed roller and the side edge portions of the banknote are brought into contact with the feed roller surface, whereby the banknote is fed by friction through this plurality of contact on the banknote itself.

4. The banknote feeding apparatus according to claim 1, characterized in that the magnetic head pad roller is placed so as to be spaced from the magnetic head by a predetermined distance.

* * * * *